US006647882B2

(12) United States Patent
Hofmann et al.

(10) Patent No.: US 6,647,882 B2
(45) Date of Patent: Nov. 18, 2003

(54) ROLLER LOCK FOR RELEASABLY FASTENING A ROLLER IN A PRINTING MACHINE

(75) Inventors: Rainer Hofmann, Leimen (DE); Werner König, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 76 days.

(21) Appl. No.: 09/829,298

(22) Filed: Apr. 9, 2001

(65) Prior Publication Data

US 2001/0029862 A1 Oct. 18, 2001

(30) Foreign Application Priority Data

Apr. 7, 2000 (DE) ..... 100 16 995

(51) Int. Cl.[7] ..... B41F 13/20; B41F 13/36

(52) U.S. Cl. ..... 101/479; 101/216; 226/194

(58) Field of Search ..... 101/479, 480, 101/216, 375; 248/201; 74/567, 569; 242/599.3, 598.3, 598.4; 226/177, 194

(56) References Cited

U.S. PATENT DOCUMENTS

| | | | | |
|---|---|---|---|---|
| 5,297,875 A | * | 3/1994 | Gattrugeri | 384/419 |
| 5,403,099 A | * | 4/1995 | Stein | 384/419 |
| 5,683,202 A | * | 11/1997 | Hummel et al. | 101/216 |

FOREIGN PATENT DOCUMENTS

| | | | | |
|---|---|---|---|---|
| DE | 1786213 | | | 1/1972 |
| DE | 26 36 555 | C2 | | 5/1977 |
| DE | 27 36 175 | A1 | | 2/1979 |
| DE | 29 32 887 | C2 | | 2/1981 |
| DE | 36 17 594 | A1 | | 12/1986 |
| DE | 82 08 650.8 | | | 7/1987 |
| DE | 41 29 840 | A1 | | 4/1992 |
| DE | 42 43 657 | C2 | | 6/1994 |
| DE | 195 11 710 | C1 | | 4/1996 |
| DE | 195 26 305 | | | 1/1997 |
| DE | 196 10 466 | A1 | | 9/1997 |
| DE | 197 14 205 | A1 | | 10/1998 |
| DE | 101 52 467 | A1 | * | 5/2002 |
| EP | 0 741 009 | B1 | | 11/1996 |
| JP | 6-47892 | | * | 2/1994 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A roller lock for releasably fastening a roller in a printing machine includes a pressure piece for retaining the roller, the pressure piece serving for exerting a retention force on a shaft journal of the roller, and the roller having two stops between which a central axis of the roller extends, both a force action line of the retention force of the pressure piece exerted on the axle journal of the roller, and a force action line of a contact force exerted on a bale of the roller being directable through the central axis; and a printing machine having the roller lock.

12 Claims, 8 Drawing Sheets

ROLLER LOCK FOR RELEASABLY FASTENING A ROLLER IN A PRINTING MACHINE

BACKGROUND OF THE INVENTION

Field of the Invention

The invention relates to a roller lock for releasably fastening a roller in a printing machine, the roller lock having a pressure piece for holding the roller.

In the published German Patent Document DE 36 17 594 A1, such a roller lock is described, wherein the pressure piece is embodied as a locking ring. The locking ring exerts a retaining force on an axle or shaft journal or kingpin of a roller secured in the roller lock, the locking ring pressing on one side of the roller lock against a ball bearing seated on the axle or shaft journal. On the opposite side of the roller lock, a compression spring which generates the retention force is inserted between the locking ring and a bearing body. For a rotation of the locking ring on the bearing body, which is required for opening and closing the roller lock, a given amount of bearing play is required between the bearing body and the locking ring. Due to the bearing play, the locking ring is lifted slightly from the bearing body by the compression spring on its side of the roller lock, as long as there is no contact force acting upon a bale or body of the roller.

It can be assumed, however, that a contact force acting upon the bale or body of the roller is exerted by a cylinder with which the roller is in rolling contact. The bearing body is formed with a unilateral insertion and removal recess, on the side of which the cylinder cannot rest on the roller, because on the side of the insertion and removal recess there must be enough free space to insert or place the roller in the roller lock and to remove the roller. Accordingly, the cylinder can rest on the roller only on the side whereon the compression spring is also located. The contact force exerted by the cylinder on the roller, the magnitude of which exceeds that of the retention force, radially displaces the ball bearing to a slight extent in the roller lock and compresses the compression spring, until the locking ring strikes the side of the compression spring on the bearing body.

When the roller lock, which is under load from the contact force, has assumed this state, a hollow space that receives the ball bearing and is located between the bearing body and the locking ring is widened by a dimension corresponding to the bearing play, and the ball bearing is no longer securely surrounded by the bearing body.

If the cylinder, for example, in the form of a plate cylinder, has a cylinder channel open at the circumference of the cylinder, then each time the roller rolls over the cylinder channel a brief reduction in the positioning force and a relieving of the roller lock occur and, as a consequence, the widened roller lock is pulled together again by the compression spring. Because of the rhythmic loading and relieving of the roller lock which occur when the roller and the cylinder roll on one another, the roller together with the intrinsically "working" roller lock begin to vibrate, which has an effect upon the printed image.

A roller lock described in the published German Patent Document DE 42 43 657 C2, which has a pressure piece embodied as a hold-down device, and a further roller lock, described in the published German Patent Document DE 195 11 710 C1, which has a pressure piece embodied as a fast-action closure, are unstable under dynamic loads of the roller in a manner similar to the roller lock described in the first reference discussed hereinabove in the published German Patent Document DE 36 17 594 A1.

In the published European Patent Document EP 0 741 009 B1, a printing press with a separable auxiliary bearing for a free end of a floatingly supported pressure roller is described. It is not possible to remove the pressure roller itself from the printing press. Instead, provision is made for removing a sleeve from the pressure roller, which requires loosening the auxiliary bearing. An axle or shaft journal of the free end of the pressure roller carries a roller bearing, which is clamped between a stop and a pressure piece, shown as an abutment, of the auxiliary bearing. The pressure piece, via the roller bearing, exerts a retention force on the axle journal that is generated by a pneumatic cylinder. A contact force exerted on a bale or body of the pressure roller by a counterpressure cylinder, such as an impression cylinder, is directed precisely in the opposite direction from that of the retention force and towards the pressure piece. If the counterpressure or impression cylinder were assumed to have a cylinder channel that the pressure roller rolls over, then, every time the pressure roller would emerge from the cylinder channel, the contact force would rise abruptly, and the roller bearing would consequently lift briefly from the stop, as it overcomes the retention force. The pneumatic cylinder, which is functionally equivalent to a soft gas-compression spring, does not prevent the abutment together with the roller bearing from being forced away from the stop by the pressure roller loaded with the increased contact force. The auxiliary bearing is therefore unstable under dynamic loads and is not suited for sheet-fed rotary printing machines wherein the impression or counterpressure cylinder is formed with at least one cylinder channel for a gripper bar, which could cause vibration of the pressure roller in the auxiliary bearing.

SUMMARY OF THE INVENTION

It is therefore an object of the invention to provide a roller lock for releasably fastening a roller in a printing machine, wherein the roller lock is stable under dynamic alternating stresses of the roller.

With the foregoing and other objects in view, there is provided, in accordance with one aspect of the invention, a roller lock for releasably fastening a roller in a printing machine, comprising a pressure piece for retaining the roller, the pressure piece serving for exerting a retention force on a shaft journal of the roller, the roller having two stops between which a central axis of the roller extends, both a force action line of the retention force of the pressure piece exerted on the axle journal of the roller, and a force action line of a contact force exerted on a bale of the roller being directable through the central axis.

In accordance with another feature of the invention, the roller lock includes a spring for generating the retention force, the pressure piece being loadable by the spring.

In accordance with a further feature of the invention, the roller lock includes a securing device for holding the pressure piece, counter to tension of the spring, in a position wherein the pressure piece is retracted from the stops.

In accordance with an added feature of the invention, the securing device comprises a detent bolt receivable in a detent notch.

In accordance with an additional feature of the invention, the spring is a leg spring.

In accordance with yet another feature of the invention, the pressure piece is a cam.

In accordance with yet a further feature of the invention, the pressure piece has a self-locking contour.

In accordance with yet an added feature of the invention, the roller lock includes a coupling having a coupling half disposed on the axle journal of the roller.

In accordance with yet an additional feature of the invention, the coupling is an articulated joint coupling.

In accordance with still another feature of the invention, the roller lock is formed with a guide face for displacing the roller axially in the direction of said central axis out of a first position and into a second position.

In accordance with still a further feature of the invention, the roller lock includes a rotary bearing for the roller, the rotary bearing being out of coincidence with the pressure piece and the stops in the first position, and coinciding with the pressure piece and the stops in the second position.

In accordance with still an added feature of the invention, in the first position, a rotary bearing of the roller is in coincidence with an insertion and removal recess, and in the second position, the rotary bearing is out of coincidence with the insertion and removal recess.

In accordance with a concomitant aspect of the invention, there is provided a printing machine having a roller lock for releasably fastening a roller in the printing machine, comprising a pressure piece for retaining the roller, the pressure piece serving for exerting a retention force on a shaft journal of the roller, the roller having two stops between which a central axis of the roller extends, both a force action line of the retention force of the pressure piece exerted on the axle journal of the roller, and a force action line of a contact force exerted on a bale of the roller being directable through the central axis.

Thus, the roller lock according to the invention for releasably fastening a roller in a printing machine, having a pressure piece for retaining the roller, calls for both a force action line of a retention force of the pressure piece exerted on a shaft journal of the roller and a force action line of a contact force exerted on a bale of the roller to be directed through a central axis of the roller between two stops of the roller lock.

The force action line of the contact force is indeed offset in the axial direction of the roller with respect to the stops, but viewed in the axial direction (in projection), it is directed between the stops.

A marked advantage of the roller lock of the invention resides in the high stability thereof in the face of alternating dynamic stresses of the roller. The roller lock is therefore especially well suited for an application wherein the roller rolls on a cylinder that has a cylinder channel, and the contact force as the roller rolls over the cylinder channel suddenly decreases and increases again, or wherein the roller rolls on a cylinder (a roller) that in turn rolls on a cylinder having a cylinder channel, and the contact force changes each time the cylinder or roller rolls over the cylinder channel.

For securing the roller in the roller lock virtually vibration-free, a rotary bearing of the roller, a bearing which is mounted on the axle journal, can be fastened between the stops on the one hand and the pressure piece on the other. Then the stops and the pressure piece between them enclose the rotary bearing, in a manner equivalent to a radial three-point bracing. Both the retention force brought to bear by the pressure piece, and the contact force brought to bear by the cylinder press the rotary bearing against the two stops, which are angularly offset from one another and protrude toward an outer circumference of the rotary bearing.

If the contact force drops briefly during the passage of the cylinder channel, the rotary bearing remains held securely in contact with both stops by the pressure piece. Because of this positive fastening of the rotary bearing, the roller is held in the radial direction practically without play or any vibration in the roller lock.

Other features which are considered as characteristic for the invention are set forth in the appended claims.

Although the invention is illustrated and described herein as embodied in a roller lock for releasably fastening a roller in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
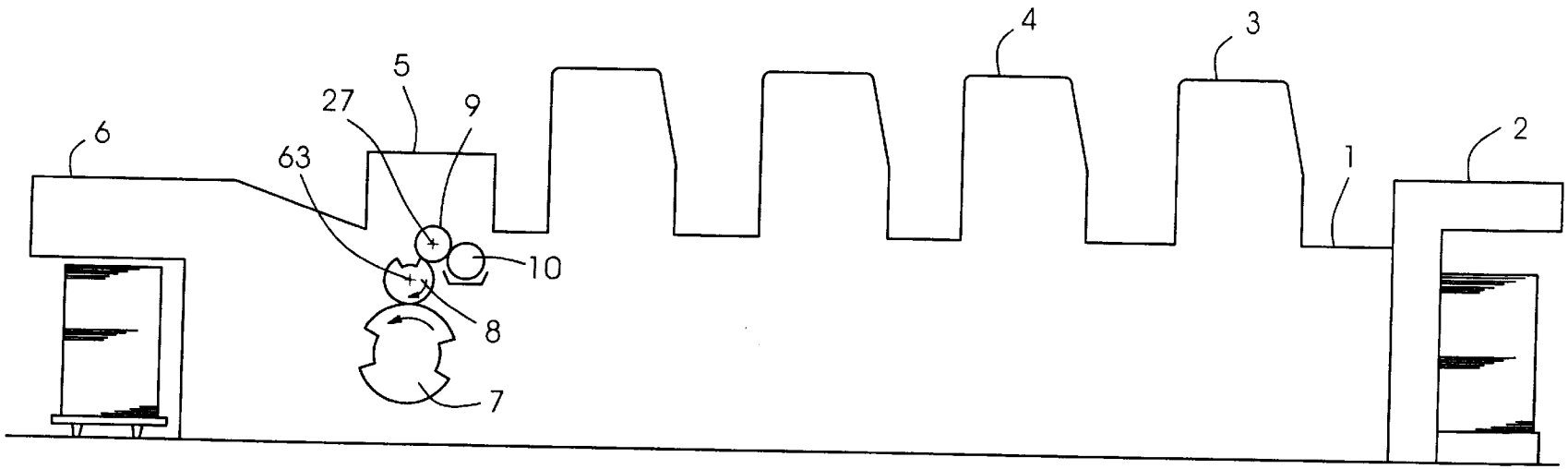
FIG. 1 is a diagrammatic side elevational view of a sheet-fed rotary offset printing machine with a varnishing or coating unit.

Referring now to the drawings and, first, particularly to FIG. 1 thereof, there is shown therein a printing machine which includes a sheet feeder 2, at least one offset printing unit 3 and 4, a varnishing or coating unit 5, and a sheet delivery 6. Constituent parts of the coating unit 5 are a so-called double-size impression or counterpressure cylinder 7, formed with two diametrically disposed cylinder channels; a single-size applicator cylinder 8, formed with one cylinder channel; and a varnish feeding device to which a roller 9 belongs, and which can be filled with a special printing ink or the like, instead of a varnish or coating material.

Onto a flexographic printing form clamped on the applicator cylinder 8, the roller 9 applies the varnish or coating material and has a dip roller 10 of the varnish feeding device, in the form of a metering roller, assigned thereto. The roller 9 can also be a screen roller, in which case a chambered doctor blade, instead of the dip roller 10, rests on the roller 9. Instead of the flexographic printing form, a rubber blanket can also be clamped on the applicator cylinder 8. Retaining devices, not shown in further detail, for firmly clamping and tautening a front and rear edge of the flexographic printing form or the rubber blanket are disposed in the cylinder channel of the applicator cylinder 8. A gripper bar, not shown in further detail, for retaining a sheet of printing material moved past the applicator cylinder 8 from the impression cylinder 7 is disposed in each cylinder channel of the impression cylinder 7. To allow the roller 9 to be removed temporarily from the printing machine 1 for maintenance purposes, or in order to enable the insertion, instead of the roller 9, of some other roller, for example, instead of a screen roller with a low fill volume, a screen roller with a larger fill volume, into the printing machine 1, a fast-action changer is provided for supporting the roller 9.

Figures 2, 2A, 2B:
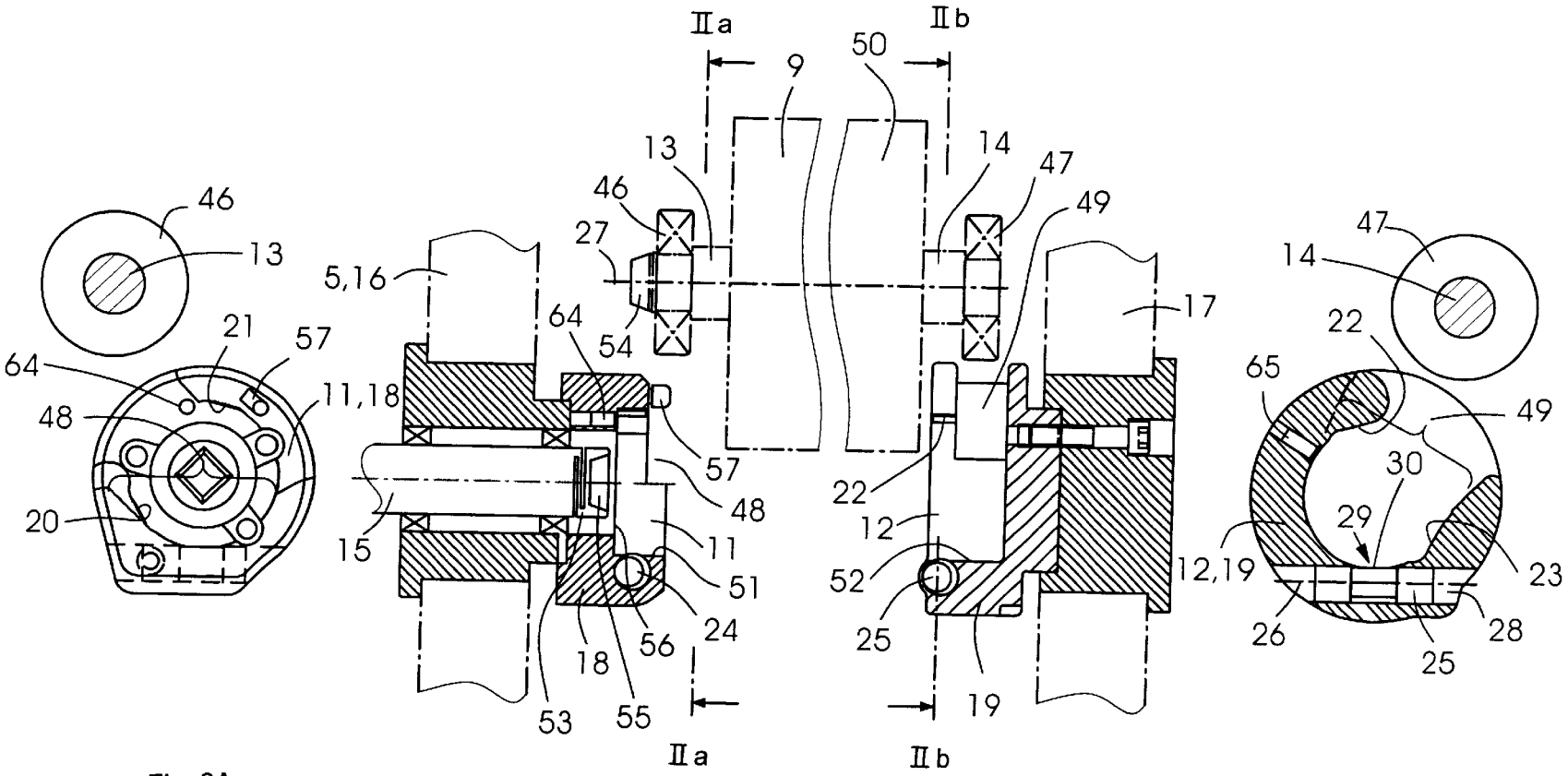
FIG. 2 is a diagrammatic side elevational view of a roller, shown partly broken away and in phantom, and a longitudinal sectional view of roller locks of a coating unit, in a state wherein the roller has not yet been inserted into the roller locks.
FIG. 2A is a cross-sectional view of FIG. 2 taken along the line IIa—IIa in the direction of the arrows.
FIG. 2B is a cross-sectional view of FIG. 2 taken along the line IIb—IIb in the direction of the arrows.

FIGS. 2, 2A and 2B show that the fast-action changer includes two roller locks 11 and 12 for receiving axle or shaft journals 13 and 14 of the roller 9. The roller lock 11 is fastened to a side wall 16 via an eccentric bushing, wherein a drive shaft 15 for rotatingly driving the roller 9 is rotatably supported by two rotary bearings. The roller lock 12 is fastened to an opposite side wall 17 via an eccentric bushing, to which the roller lock 12 is screwed.

Each of the roller locks 11 and 12 includes a bearing body 18 and 19, of approximately annular segmental cross section, respectively, on each of which two flat-faced stops 20, 21 and 22, 23, respectively, are embodied. A respective pressure piece 24 and 25 is mounted so as to be rotatable about a pivot axis 26 in each bearing body 18 and 19; when the roller 9 is secured in the roller locks 11 and 12, the pivot axis is not oriented parallel to a central axis 27 of the roller 9 but rather at an angle that is greater than 0° and smaller than 180° and is preferably approximately 90°.

The following exemplary description of the support and drive of the pressure piece 25 applies to the pressure piece 24, as well.

The pressure piece 25, embodied as an irreversible cam, is rotatably mounted in a tangential bore 28, which determines the pivot axis 26 and in which a radial clamping window 29 that is open towards the interior of the bearing body 19 terminates. The clamping window 29 is disposed in the adjusting and rotation range, respectively, of a tautening and clamping face 30, respectively, of the pressure piece 25.

Figure 8:
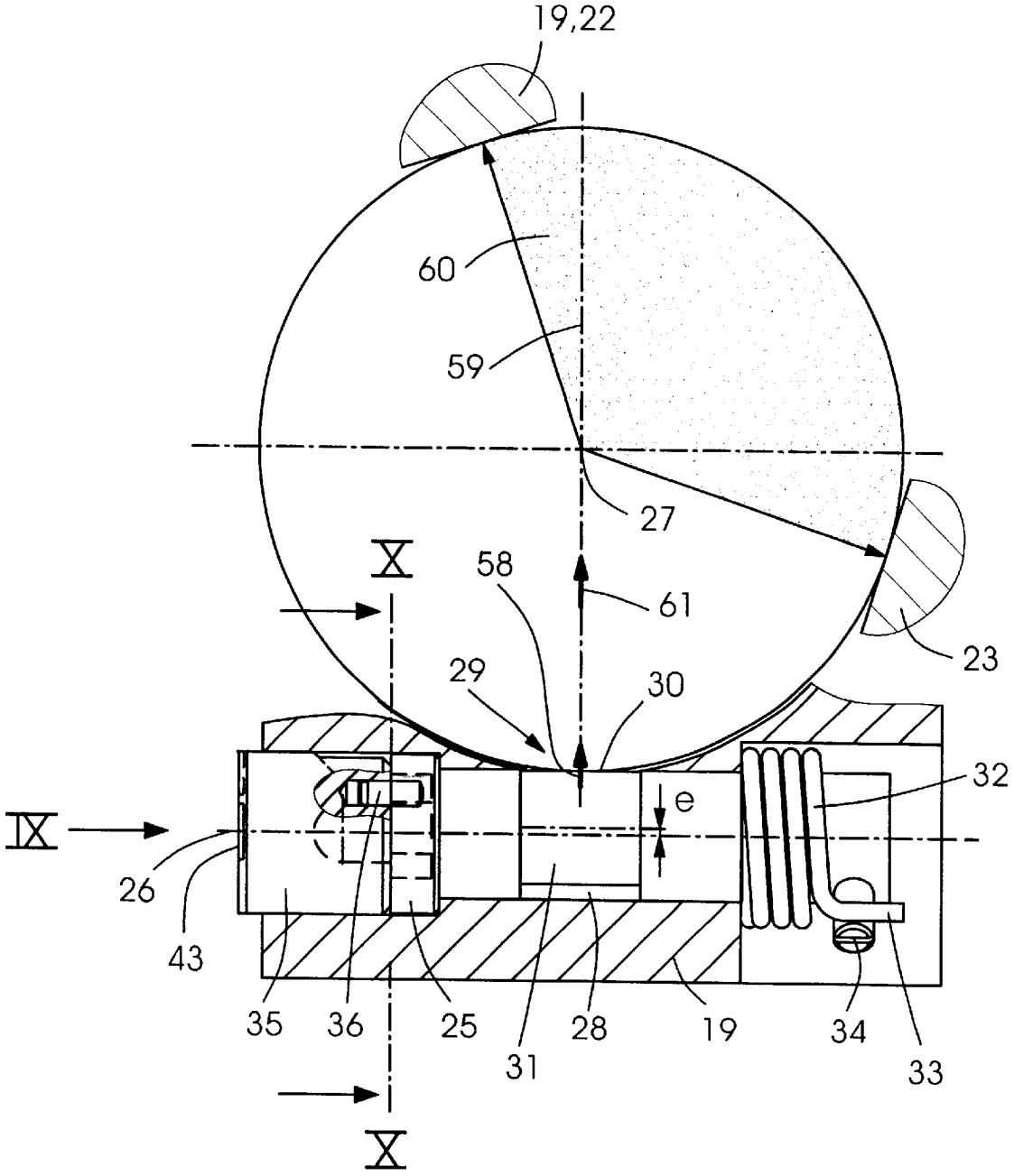
FIG. 8 is a view similar to that of FIG. 5 wherein the eccentric or cam has a rotational position which is different from that of FIG. 5 and is rotated towards the stops.

FIG. 8 shows that the clamping face 30 is embodied on a cylindrical offset 31 of the pressure piece 25 which has a diameter that is less than the diameter of two offsets, immediately adjacent the offset 31, of the pressure piece 25, and which is offset axially parallel to the pivot axis 26 by the amount of an eccentricity e. A spring 32, embodied as a leg spring or in other words a torsion spring and loading the pressure piece 25, is coiled around the pressure piece 25 and is braced with one non-illustrated leg against the bearing body 19 and with the other leg 33 thereof against the pressure piece 25, via a transverse pin 34. The spring 32 is thus retained between the bearing body 19 and the pressure piece 25 with an initial tension that acts to urge the pressure piece 25 around the pivot axis 26. A cylindrical control element 35 is rotatably mounted, coaxially to the pressure piece 25, in the bearing body 19 and can be coupled for rotation with the pressure piece 25 via a longitudinal pin 36 that functions as an entrainer or slaving member.

Figure 10:
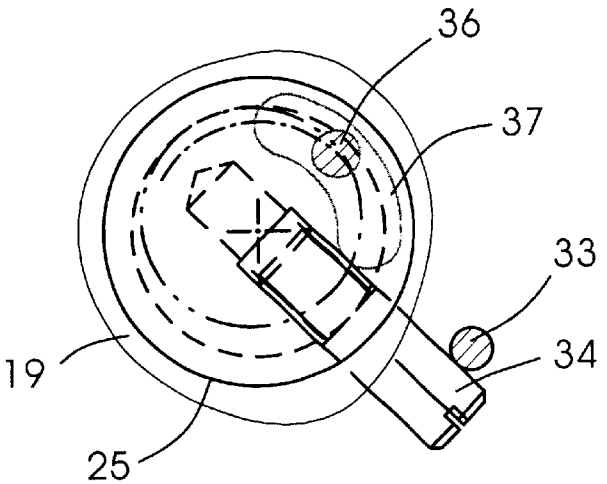
FIG. 10 is a sectional view of FIG. 8 taken along the line X—X in the direction of the arrows, and showing the sliding block guide in a different rotational position than in FIG. 7.

In FIG. 10, the longitudinal pin 36 is shown protruding into a groove 37, extending in an arc about the pivot axis 26 and introduced into a planar face of the pressure piece 25.

Figure 9:
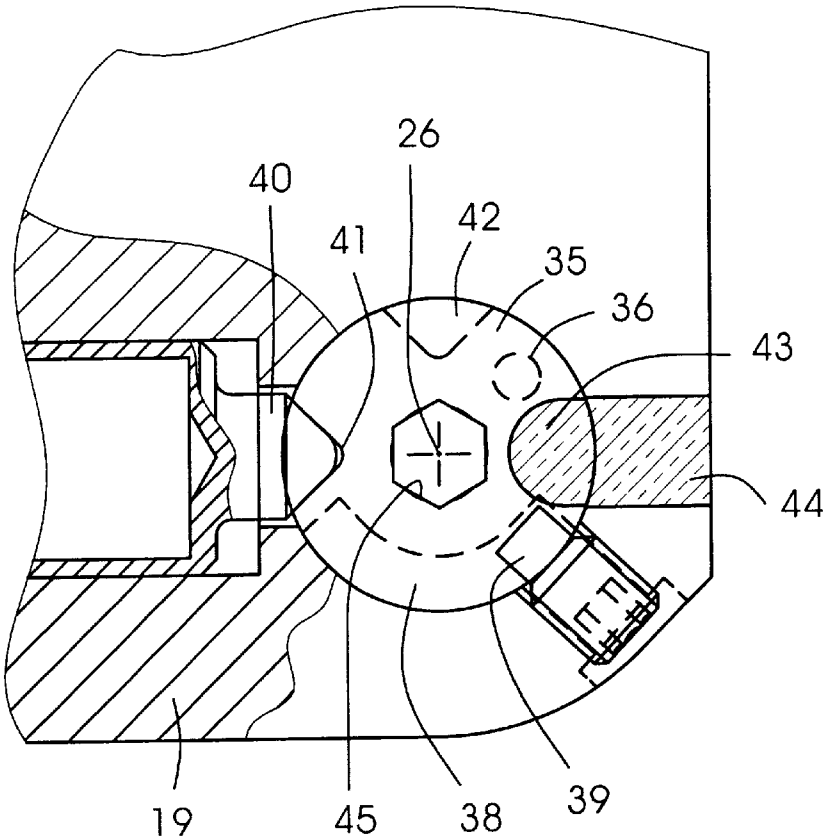
FIG. 9 is a side elevational view as seen in the direction of the arrow IX in FIG. 8, of the control element and the detent, with the detent engaged in the control element differently from and modified with respect to the manner thereof shown in FIG. 6.

In FIG. 9, a further groove 38 is shown which is formed in the circumference of the control element 35, and this groove 38 is engaged in by a pin 39, which is screwed into the bearing body 19 and functions as a stop which limits the angle of rotation of the control element 35. A detent bolt 40 embodied as a spring bolt is inserted and screwed into the bearing body 19 and, depending upon the rotational position of the control element 35, this detent bolt 40 enters a detent notch 41 or a detent notch 42 in the circumference of the control element 35. The control element 35 is provided with an indented, colored marking 43 which, at a given rotational position of the control element 35, is opposite (note FIG. 9) the same kind of marking 44 in the bearing body 19, and in another rotational position of the control element 35 is not located opposite the marking 44 (note FIG. 6), and which thus indicates the set rotational position of the control element 35 at the time. The control element 35 has a form-locking and preferably polygonal shape for a leverlike socket wrench for turning the control element 35 and, by way thereof, the pressure piece 25; this shape, for example, in the form of a hexagonal socket 45 or the like, allows insertion of the socket wrench into the control element 35 or is provided for allowing the socket wrench to be placed on the control element 35. With regard to the form-locking shape, it is noted that a form-locking connection is one which connects two elements together due to the shape of the elements themselves, as opposed to a force-locking connection, which locks the elements together by force external to the elements The function of the roller locks 11 and 12 are explained hereinafter:

In a first method step, shown in FIG. 2, the roller 9 is placed in the roller locks 11 and 12, whereupon rotary bearings 46 and 47, seated on the axle journals 13 and 14 and embodied as roller bearings, are passed through insertion and removal recesses 48 and 49 of the bearing bodies 18 and 19. Viewed from a bale or body 50 of the roller 9 in the direction of the roller lock 12, the insertion and removal recess 49 in part forms an undercut of the bearing body 19.

Figure 3B:
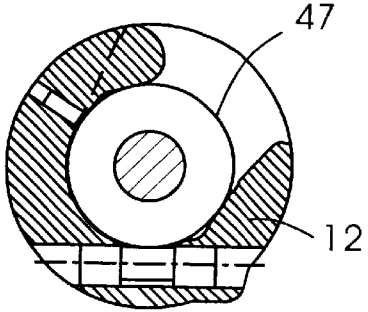
FIG. 3B is a cross-sectional view of FIG. 3 taken along the line IIIb—IIIb in the direction of the arrows.
Figure 3:
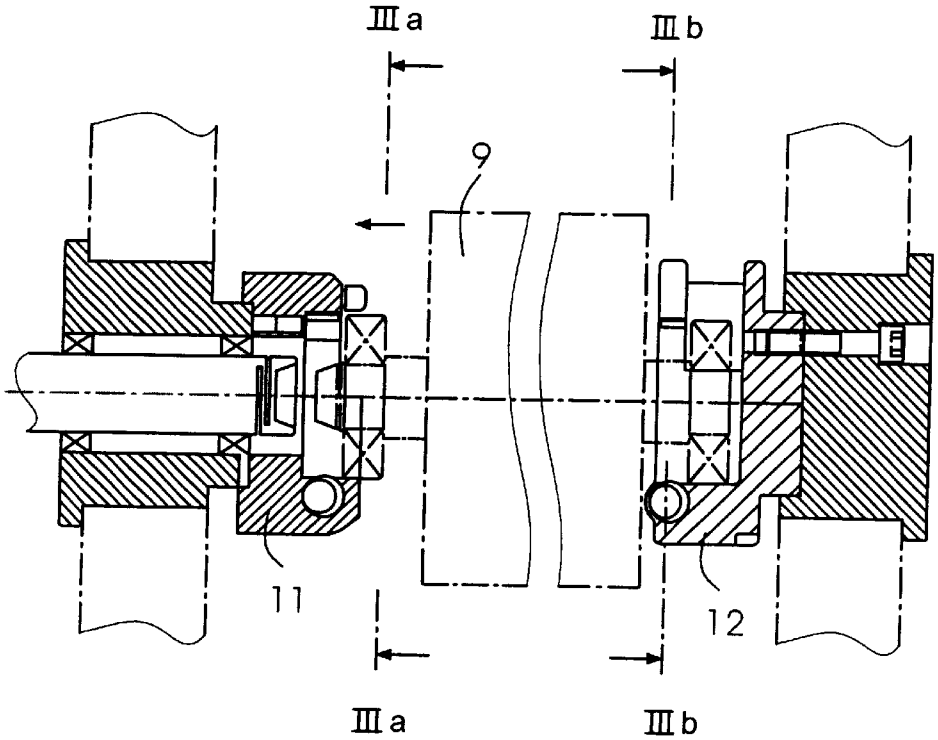
FIG. 3 is a view similar to that of FIG. 2, but with the roller inserted in the roller locks, however, in a yet non-secured or unlocked state.
Figure 3A:
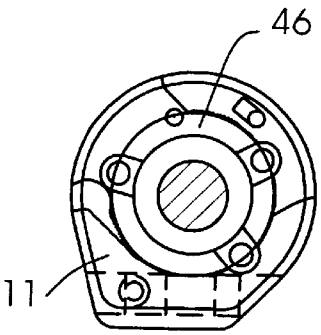
FIG. 3A is a cross-sectional view of FIG. 3 taken along the line IIIa-lIIa in the direction of the arrows.

After the rotary bearings 46 and 47 have been placed freely on guide faces 51 and 52 of the bearing bodies 18 and 19, the guide faces 51 and 52 forming linear and axial guides, as shown in FIG. 3, the roller 9, in a second method step, is displaced axially along these guide faces 51 and 52 towards the roller lock 11, with the rotary bearings 46 and 47 sliding along the guide faces 51 and 52. The roller 9 is displaced far enough towards the roller lock 11 so that the rotary bearing 46 strikes a stop face 56; at the moment of impact, the rotary bearing 46 is in coincidence with the pressure piece 24 and the stops 20 and 21, and at the same time, the rotary bearing 47 is in coincidence with the pressure piece 25 and the stops 22 and 23.

As a result of the displacement, a coupling 53, which includes one coupling half 54 mounted on the roller 9 and one coupling half 55 structurally fixed to the frame and supported in the side wall 16, is closed. The coupling 53 serves the purpose of positively or form-lockingly transmitting a rotational drive moment from the drive shaft 15 to the roller 9. The coupling half 54 forms a centering tip of the axle journal 13 and is embodied as a truncated pyramid with a square base.

In a departure from the exemplary embodiment shown, wherein the coupling half 54 enters the coupling half 55, a transposed association of the coupling halves 54 and 55, which can be inserted into one another, is also conceivable, wherein the coupling half of the roller 9 is fitted over the coupling half of the drive shaft 15.

The coupling 53 is a so-called compensation coupling, which is embodied as angularly movable to compensate for an intermittent inclination of the central axis 27 relative to a central axis of the drive shaft 15. The angular mobility of the coupling 53 is defined by it being embodied as a so-called jointed coupling, and more precisely as a spring jointed coupling.

Figures 4, 4A, 4B:
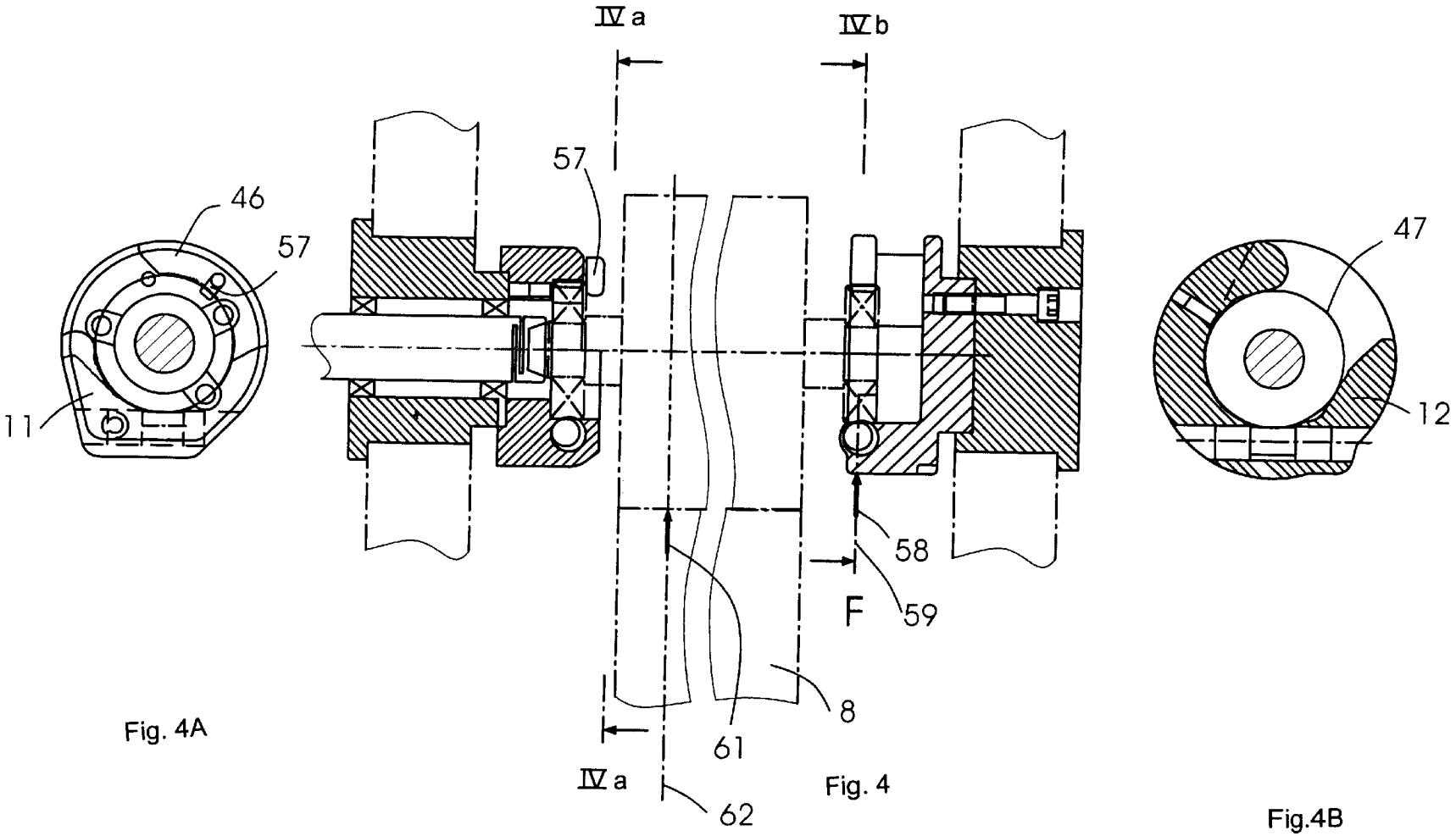
FIG. 4 is a view similar to that of FIG. 3, but with the roller shown not only inserted in the roller locks but also in a secured or locked state therein.
FIG. 4A is a cross-sectional view of FIG. 4 taken along the line IVa—IVa in the direction of the arrows.
FIG. 4B is a cross-sectional view of FIG. 4 taken along the line IVb—IVb in the direction of the arrows.
Figure 5:
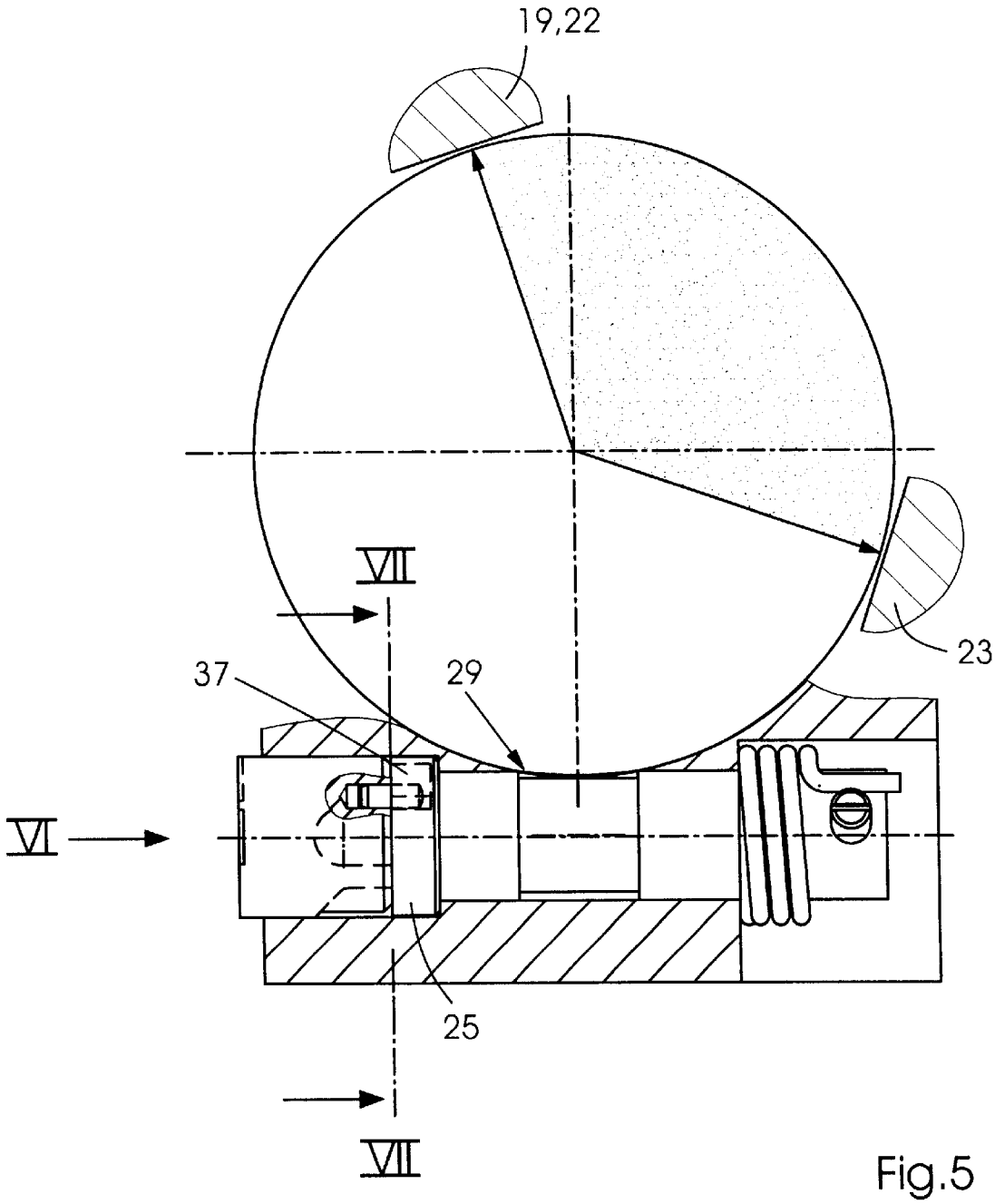
FIG. 5 is an enlarged fragmentary view of FIG. 2B showing in greater detail one of the roller locks, from which an eccentric or cam connected to a control element is shown in a position retracted from the stops of the roller lock.
Figure 7:
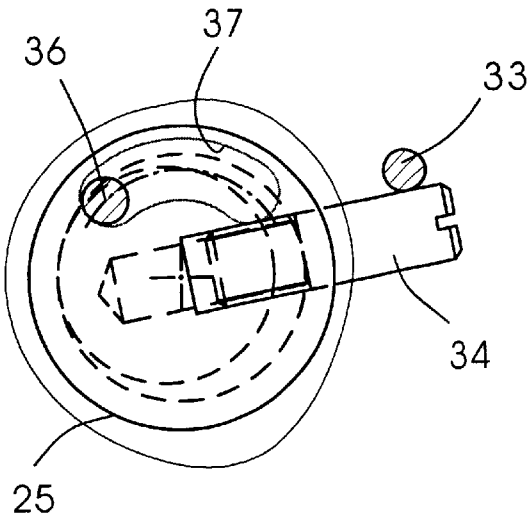
FIG. 7 is a sectional view of FIG. 5 taken along the line VII—VII in the direction of the arrows, and showing a coulisse or sliding block guide for rotational entrainment or slaving of the eccentric or cam by the control element.

Once the roller 9, after the displacement thereof, is located in the requisite axial position relative to the pressure pieces 24 and 25, which position is signalled by a sensor 64 of the printing press 1 that is oriented axially parallel to the roller 9 and disposed in the roller lock 11, or more precisely beneath the stop face 56 of the bearing body 18, and a plane face of the rotary bearing 46 rests on the stop face 56, this axial position of the roller 9 is secured, in a third method step, by a securing device 57. The securing device 57 includes a locking bar, mounted rotatably on the bearing body 18, that is rotatable or adjustable for securing purposes out of a position retracted from the rotary bearing 46 (note FIG. 3) into a position (note FIG. 4) that engages the rotary bearing 46 from behind on the side of the rotary bearing remote from the stop face 56.

After the coupling 53 is closed, and a positive or form-locking rotational entrainment or slaving of the roller 9 by the drive shaft 15 is thus made possible, and after the securing device 57 has been pivoted into the blocking position and, as a result, the roller 9 is restrained axially practically without play, an axial securing of the roller 9 in the roller locks 11 and 12 is effected, in a fourth method step. To secure the roller 9 radially, each of the pressure pieces 24 and 25, respectively, is adjusted into a tautening or clamping position and, in the process, the applicable clamping face 30 is adjusted towards the clamping window 29. For example, to rotate the pressure piece 25 into the clamping position, the socket wrench is inserted into the control element 35, and the control element is then rotated about the pivot axis 26. In the rotation of the control element 35, an inside face of the groove 37 at an end side presses against the longitudinal pin 36, and as a result the pressure piece 25 is entrained or slaved by the groove 37.

In order for a constant retention force 58, which is unaffected by operating factors, such as a variably great operating force exerted from one user to another on the control element 35 via the socket wrench, to be exerted on the rotary bearing 47, this retention force is not transmitted to the pressure piece 25 via the control element 35 but rather exclusively by the spring 32. The rotation of the control element 35 trips a securing device, formed by the detent bolt 40 and the detent notch 42, which keeps the respective pressure piece 24 and 25 in a retracted position compared to the clamping position, counter to the prestressing force of the spring 32. In other words, the control element 35 is rotated only strongly enough and far enough that the detent bolt 40 snaps out of the detent notch 42 and, in the course of the rotation, enters the detent notch 41.

As can be seen from FIG. 10, after the rotation of the control element 35, the longitudinal pin 36 is in a free intermediate position between the terminal inside faces of the groove 37, in terms of the direction of rotation of the groove 37, so that the driving connection between the groove 37 and the longitudinal pin 36 is broken when the detent bolt 40 is located in the detent notch 41.

Figure 6:
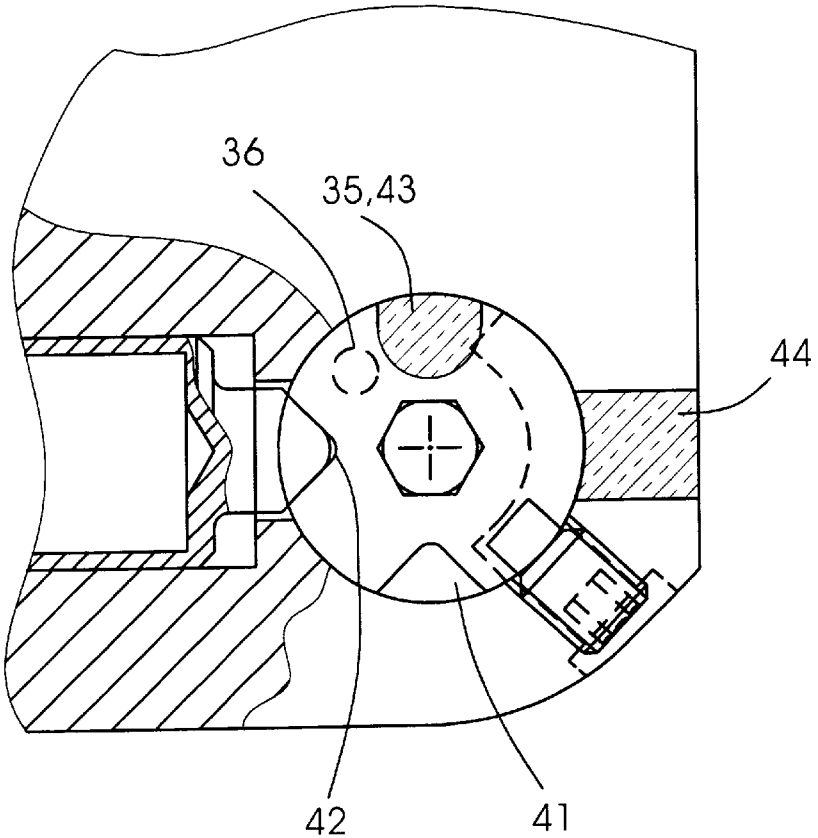
FIG. 6 is a side elevational view as seen in the direction of the arrow VI in FIG. 5, of the control element and of a detent firmly retaining the eccentric or cam in the retracted position.

After the switchover of the securing device, formed by the detent bolt 40, from the position thereof shown in FIG. 6 to the position in FIG. 9, the prestressing force of the spring 32 is enabled, so that the pressure piece 24 and 25, respectively, as applicable are now rotated solely by the spring 32 into the clamping position of FIG. 8. By the adjustment of the pressure piece 25 towards the stops 22 and 23, the play that previously still existed between the rotary bearing 47 and the stops 22 and 23 is eliminated, so that the rotary bearing 47 is held without play between the stops 22 and 23 and the clamping face 30.

By the fact that the pin 39 strikes an inner end face of the groove 38, rotation of the control element 35 past the rotational position wherein the detent bolt 40 is seated in the detent notch 41 is prevented. This position of the control element 35 and thus the clamping position of the pressure piece 24 and 25, respectively, is indicated by the opposed position of the markings 43 and 44. In other words, the force exerted by the operator on the control element 35 via the socket wrench is precluded from being transmitted as a retention force 58 to the roller 9. The retention force 58 is brought to bear solely by the spring 32.

When the pressure piece 25 is in the clamping position, the clamping face 30 emerges from the clamping window 29 in the direction of the rotary bearing 47 and presses this rotary bearing against the rigid stops 22, 23. A line axially parallel to the pivot axis 26 on the jacket face of the pressure piece 25, on which line the clamping face 30 is located, then spans the guide face 52 which, in profile, (note FIG. 8) is concavely rounded and adapted to the rotary bearing 47, in the manner of a secant. The rotary bearing 47 is fastened both nonpositively and positively or form-lockingly between the pressure piece 25 and the associated stops 22, 23. The proper axial position of the rotary bearing 47 in coincidence with the stops 22 and 23 is signalled to the printing machine 1 by a sensor 65 disposed in the roller lock 12, or more precisely, in the bearing body 19, and oriented radially to the roller 9. Each of the sensors 64 and 65 is linked by control technology to an electronic control unit of the printing machine 1. In accordance with the signals received from the sensors 64 and 65, the control unit indicates various operating states to the printing machine 1, such as "typing mode possible". The retention force 58 acts along a force action line 59, which is established through the central axis 27 and further inside a circular sector, which is defined by the central axis 27 and contact lines or points, in this case contact lines, of the stops 22, 23. In the position of the pivot axis 26 perpendicular to the central axis 27, this results in a contact point on the clamping face 30 that together with the center point of the roller 9 and of the rotary bearing 47, i.e., the central axis 27, predetermines the rectilinear direction of the force action line 59. The retention force 58, exerted on the applicable axle or shaft journal 14 by the spring 32 via the pressure piece 25 and the rotary bearing 47, causes wedging of the rotary bearing 47 between the respective stops 22, 23 associated with this rotary bearing. In other words, the rotary bearing 46 is restrained between the pressure piece 24 and the stops 20 and 21, and the rotary bearing 47 is restrained between the pressure piece 25 and the stops 22 and 23, solely at three pointlike contact places, which, however, do not have a large area, in a three-sided enclosure. The point form of the contact places is due to a very slight roundedness or curvature, which therefore cannot be seen in FIGS. 2 to 4, of the outer rings of the rotary bearings 46–47 in the direction of the central axis 27.

In embodiments which depart from the exemplary embodiment shown, either one, two or all three of the contact places may be in the form of a line parallel to the central axis 27.

An operating or contact force 61 exerted on the roller 9 by the applicator cylinder 8 in the radial direction (towards the central axis 27) acts along a force action line 62, which extends in a straight line through the central axis 27 and also through a central axis 63 of the applicator cylinder 8. Viewed in the axial direction of the cylinder 8 and the roller 9, the force action line 62 is congruent with the force action line 59 either ahead of or behind it, depending upon which roller lock 11 and 12 is being looked at. The contact force 61 that presses on the bale 50 thus presses the rotary bearing 46 or 47 against the stops 20, 21 or 22, 23 that respectively brace the rotary bearing 46 or 47, in the same way as does the retention force 58. In other words, the force action line 62 extends in the same way as the force action line 59 inside the circular sector 60. If the roller 9 passes through the cylinder channel of the applicator cylinder 8 and the contact force 61 as a result briefly decreases in the magnitude thereof, then the roller 9 is retained by the spring-loaded pressure pieces 24 and 25 securely and without vibration on the stops 20 to 23.

With regard to the pivot axis 26, the pressure pieces 24 and 25 are contoured in self-locking or irreversible manner by the clamping face 30 that rises in spiral or wedgelike form; that is, even if it is assumed that there is no spring 32, the roller 9 under alternating stress from the contact force 61 could not force or rotate the pressure pieces 24 and 25 out of the clamping position already assumed, because of the self-locking. The spring 32 that is actually present and that keeps the applicable pressure piece 24 and 25 in the clamping position serves for additional security. If the rotary bearing 47 is pressed harder against the stops 22, 23 by the contact force 61, then a corresponding readjustment of the pressure piece 25 by the spring 32 takes place automatically.

A transposed order of the third and fourth method steps is also possible, wherein the roller 9 is first radially secured by the detent notches 24 and 25, and only thereafter is this roller axially secured by the securing device 57.

The removal of the roller 9 from the printing machine 1 is effected in reverse order of the method steps described. After the clamps of the pressure pieces 24 and 25 are loosened and the securing device 57 is unlocked, the roller 9 is axially displaced in the direction of the roller lock 12 and thereby uncoupled from the drive shaft 15. After that, the roller 9 is removed from the roller locks 11 and 12 in a direction perpendicular to the central axis 27, and the rotary bearings 46 and 47 are passed through the insertion and removal recesses 48 and 49.

We claim:

1. A roller lock for releasably fastening a roller in a printing machine, the roller having a rotary bearing and a roller body supported on an axle journal and defining a central axis, the roller lock comprising:

a bearing body for supporting the roller;

said bearing body including a guide face forming an axial guide for displacing the roller axially in the direction of said central axis out of a first position and into a second position;

an adjustable pressure piece disposed in said bearing body for retaining the roller, said pressure piece being adjustable selectively into and out of a clamping position, said pressure piece being in clamping contact with the rotary bearing in said clamping position for exerting a retention force on the rotary bearing and the axle journal of the roller; and two stops disposed on said bearing body engaging and supporting the rotary bearing;

said pressure piece and said two stops being disposed for directing a force line of action of the retention force exerted on the axle journal and a force line of action of a contact force exerted on the roller body through the central axis of the roller and between said stops.

2. The roller lock according to claim 1, including a spring for generating said retention force, said pressure piece being loadable by said spring.

3. The roller lock according to claim 2, including a securing device for holding said pressure piece, counter to tension of said spring, in a position wherein said pressure piece is retracted from said stops.

4. The roller lock according to claim 3, wherein said securing device comprises a detent bolt receivable in a detent notch.

5. The roller lock according to claim 2, wherein said spring is a leg spring.

6. The roller lock according to claim 1, wherein said pressure piece is a cam.

7. The roller lock according to claim 1, wherein said pressure piece has a self-locking contour.

8. The roller lock according to claim 1, including a coupling having a coupling half adapted to be disposed on the axle journal of the roller.

9. The roller lock according to claim 8, wherein said coupling is an articulated joint coupling.

10. The roller lock according to claim 1, wherein the rotary bearing is out of coincidence with said pressure piece and said stops in the first position of the roller, and coincides with said pressure piece and said stops in the second position of the roller.

11. The roller lock according to claim 1, wherein the roller lock has an insertion and removal recess formed therein and in the first position of the roller, the rotary bearing of the roller is in coincidence with said insertion and removal recess, and in the second position of the roller, the rotary bearing is out of coincidence with said insertion and removal recess.

12. A printing machine having a roller lock for releasably fastening a roller in the printing machine, the roller having a rotary bearing and a roller body supported on an axle journal and defining a central axis, the roller lock comprising:

a bearing body for supporting the roller;

said bearing body including a guide face forming an axial guide for displacing the roller axially in the direction of said central axis out of a first position and into a second position;

an adjustable pressure piece disposed in said bearing body for retaining the roller, said pressure piece being adjustable selectively into and out of a clamping position, said pressure piece being in clamping contact with the rotary bearing in said clamping position for exerting a retention force on the rotary bearing and the axle journal of the roller; and two stops disposed on said bearing body engaging and supporting the rotary bearing;

said pressure piece and said two stops being disposed for directing a force line of action of the retention force exerted on the axle journal and a force line of action of a contact force exerted on the roller body through the central axis of the roller and between said stops.

* * * * *